US005558569A

United States Patent [19]

Lee

[11] Patent Number: 5,558,569

[45] Date of Patent: Sep. 24, 1996

[54] GRINDING HEAD MOUNTING STRUCTURE FOR PORTABLE GRINDING MACHINES

[76] Inventor: Tai-Wang Lee, 7-4 Fl., No. 187, Chung Hsiao Rd., Taichung, Taiwan

[21] Appl. No.: 420,806

[22] Filed: Apr. 12, 1995

[51] Int. Cl.[6] ..... B24B 23/00

[52] U.S. Cl. ..... 451/356; 451/342; 451/344; 451/357

[58] Field of Search ..... 451/342, 344, 451/354, 356, 357, 359, 363

[56] References Cited

U.S. PATENT DOCUMENTS

| | | | |
|---|---|---|---|
| 2,197,626 | 4/1940 | Scheven | 451/356 |
| 2,614,369 | 10/1952 | Robins | 451/356 |
| 3,763,531 | 10/1973 | Dancsik | 451/356 |
| 4,625,462 | 12/1986 | Fushiya et al. | 451/357 |
| 4,854,085 | 8/1989 | Huber | 451/357 |
| 5,123,216 | 6/1992 | Kloss et al. | 451/344 |
| 5,319,889 | 6/1994 | Rudolf et al. | 451/359 |
| 5,398,454 | 3/1995 | Berner | 451/357 |
| 5,398,457 | 3/1995 | Uppegrave et al. | 451/356 |

*Primary Examiner*—D. S. Meislin
*Assistant Examiner*—Eileen P. Morgan
*Attorney, Agent, or Firm*—Bacon & Thomas

[57] ABSTRACT

A grinding head mounting structure including a tubular eccentric base shaft coupled to the driving shaft of the grinding machine by a screw member, an abrasive plate holder base having a bottom coupling portion coupled to the tubular eccentric base shaft by a mandrel and a triangular top platform fixed with an abrasive plate, a swinging member having an arched base movably mounted around a circular block on the machine base of the grinding machine by a split ring and a clamp and a rectangular top coupling portion coupled to a rectangular block on the abrasive plate holder base.

1 Claim, 3 Drawing Sheets

GRINDING HEAD MOUNTING STRUCTURE FOR PORTABLE GRINDING MACHINES

BACKGROUND OF THE INVENTION

Various portable power grinding machines have been disclosed, and have appeared on the market. These portable power grinding machines are widely invited for the advantage of mobility. In recent years, DIY (do-it-yourself) furnitures and apparatus have become more and more popular. Therefore, the demand for portable power grinding machines is more and more stronger. However, the grinding heads of regular portable power grinding machines are commonly not replaceable and designed for a specific use only. Therefore, for different grinding purposes, different grinding machines shall be prepared.

SUMMARY OF THE INVENTION

It is one object of the present invention to provide a grinding head mounting structure which fits any of a variety of portable grinding machines. It is another object of the present invention to provide a grinding head mounting structure which can be conveniently dismantled for a repair or replacement work. According to the preferred embodiment of the present invention, the grinding head mounting structure comprises a tubular eccentric base shaft coupled to the driving shaft of the grinding machine by a screw member, an abrasive plate holder base having a bottom coupling portion coupled to the tubular eccentric base shaft by a mandrel and a triangular top platform fixed with an abrasive plate, a swinging member having an arched base movably mounted around a circular block on the machine base of the grinding machine by a split ring and a clamp and a rectangular top coupling portion coupled to a rectangular block on the abrasive plate holder base. When the grinding machine is started, the abrasive plate holder base is vibrated when turned by the tubular eccentric base shaft.

DETAILED DESCRIPTION OF THE PREFERRED EMBODIMENT

Figure 1:
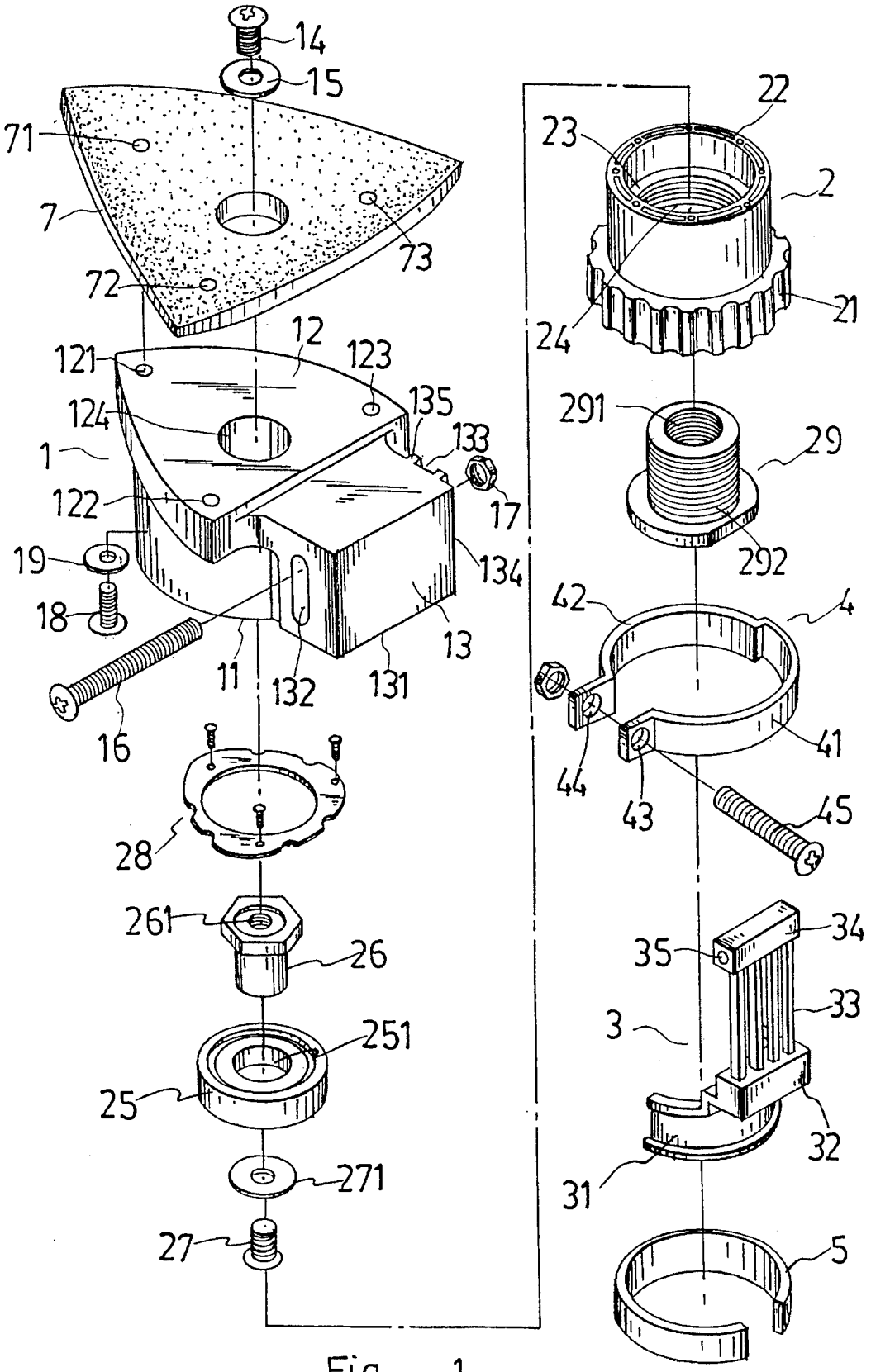
FIG. 1 n exploded view of a grinding head mounting structure according to the present invention.

Referring to FIG. 1, a grinding head mounting structure in accordance with the present invention is generally comprised of an abrasive plate holder base 1, a tubular eccentric base shaft 2, a swinging member 3, a clamp 4, and a split ring 5. The abrasive plate holder base 1 comprises a tubular coupling portion 11, a substantially triangular platform 12 at the top of the tubular coupling portion 11, a center countersunk hole 124 at the center of the triangular platform 12, three countersunk holes 121, 122 and 123 at the three angles of the triangular platform 12, a rectangular block 13 extended from the triangular platform 12 and the tubular coupling portion 11 at one side, a chamber 131 defined within the rectangular block 13 at the bottom, a first oblong slot 132 and a second oblong slot 133 vertically disposed on the rectangular block 13 at two opposite lateral sides and communicated with each other, and two vertical ribs 134 and 135 raised along two opposite lateral sides of the second oblong slot 133. The tubular eccentric base shaft 2 comprises a vertically grooved outward flange 21 around the periphery at the bottom, a plurality of screw holes 22 equiangularly spaced on the topmost edge thereof, an inside annular flange 23, and a bottom screw hole 24. A bearing 25 which has a center through hole 25I is mounted within the tubular eccentric base shaft 2 and supported above the inside annular flange 23. A headed mandrel 26 which has a center screw hole 261 is inserted through the center through hole 251 with its head stopped above the bearing 25. A screw 27 is mounted with a washer 271 and then threaded into the center screw hole 261 from the bottom side to secure the mandrel 26 to the bearing 25. A trefoil-like ring plate 28 is fastened to the screw holes 22 on the topmost edge of the tubular eccentric base shaft 2. A screw member 29 is provided having an outer thread 292 threaded into the bottom screw hole 24 on the tubular eccentric base shaft 2, and an inner thread 291. The swinging member 3 comprises an arched base 31, a stepped horizontal block 32 raised from the arched base 31, a rectangular coupling portion 34 spaced above the stepped horizontal block 32 and having a longitudinal center through hole 35, and a plurality of vertical rods 33 connected between the stepped horizontal block 32 and the rectangular coupling portion 34. The clamp 4 is comprised of a first half-round strip 41 and a second half-round strip 42 longitudinally connected and terminating in a respective eyed end 43 or 44 for connection to each other by a screw bolt 45. The diameter of the first half-round strip 41 is longer than that of the second half-round strip 42.

Figure 2:
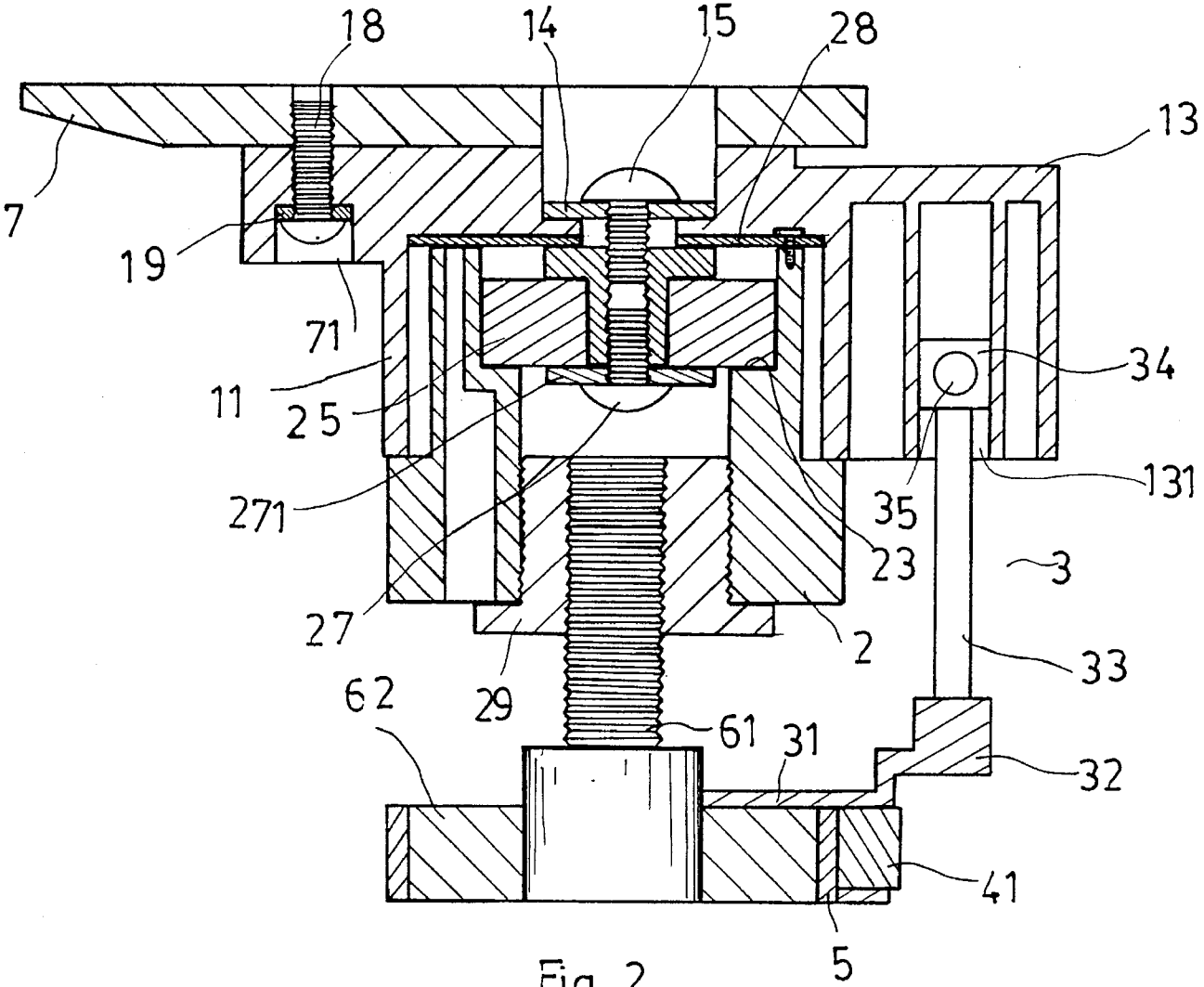
FIG. 2 is an assembly view in section of the grinding head mounting structure shown in FIG. 1.
Figure 3:
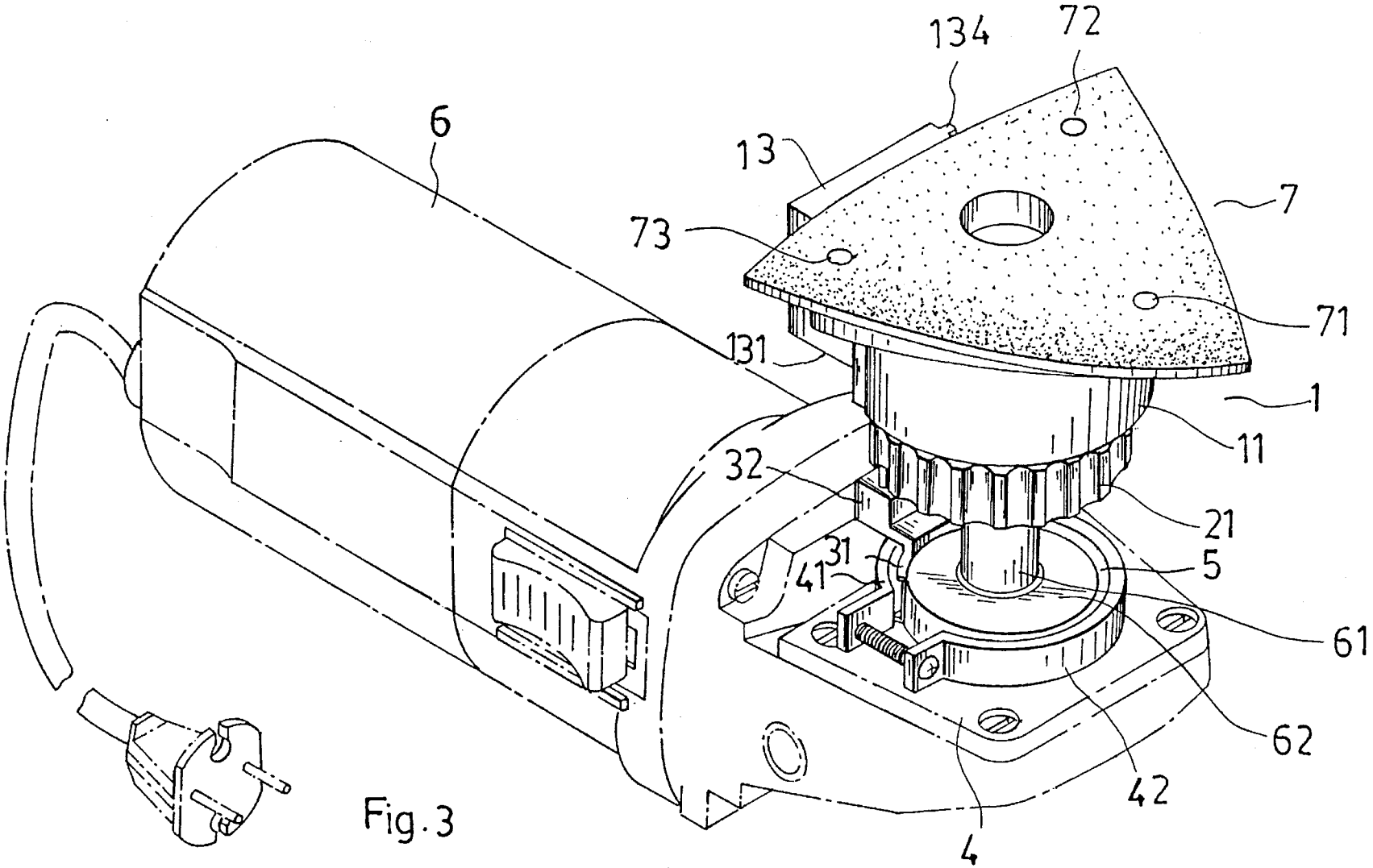
FIG. 3 is an elevational view showing the grinding head mounting structure of FIG. 1 installed in a portable grinding machine.

The assembly process of the grinding head mounting structure is outlined hereinafter with reference to FIGS. 2 and 3, the tubular coupling portion 11 of the abrasive plate holder base 1 is mounted on the tubular eccentric base shaft 2, then a screw 14 is mounted with a washer 15 and then threaded into the center countersunk hole 124 on the abrasive plate holder base 1 and the screw hole 261 on the headed mandrel 26, then the rectangular coupling portion 34 is inserted into the chamber 131 on the rectangular block 13 of the abrasive plate holder base 1 and then a screw 16 is inserted through the first oblong slot 132 and the longitudinal center through hole 35 on the rectangular coupling portion 34 and the second oblong slot 133 and screwed up with a nut 17 to secure the swinging member 3 to the abrasive plate holder base 1, then the screw member 29 is fastened to the driving shaft 61 on the machine base 6 of the grinding machine by threading the threaded top end of the driving shaft 61 into the inner thread 291 of the screw member 29, then the split ring 5 is mounted around the circular block 62, which is disposed around the driving shaft 61, and secured in place by the clamp 4, permitting the arched base 31 of the swinging member 3 to be retained between the split ring 5 and the first half-round strip 41 of the clamp 4. When the grinding head mounting structure is assembled, an abrasive plate 7 is fixed to the triangular platform 12 of the abrasive plate holder frame 1 at the top. The abrasive plate 7 has three screw holes 71, 72 and 73 respectively fastened to the countersunk holes 121, 122 and 123 on the platform 12 by respective screws 18 and washers 19.

When in use, when the driving shaft 61 is rotated, the tubular eccentric base shaft 2 is driven to turn the abrasive plate holder base 1. Because of the constraint of the swinging member 3, the abrasive plate holder base 1 is oscillated when it is turned by the tubular eccentric base shaft 2.

I claim:

1. A grinding head mounting structure for a motor-driven grinding machine having a threaded driving shaft and a circular block raised from a machine base thereof around said motor-driven driving shaft, the grinding head mounting structure comprising:

an abrasive plate holder base, said abrasive plate holder base comprising a tubular coupling portion, a triangular platform horizontally disposed above said tubular coupling portion, a center countersunk hole at the center of said triangular platform, three border countersunk holes at the three angles of said triangular platform for mounting an abrasive plate by screws, a rectangular block extended from said triangular platform and said tubular coupling portion at one side, a chamber on a bottom side of said rectangular block, a first oblong slot and a second oblong slot vertically disposed on said rectangular block at two opposite lateral sides and communicated with each other, and two vertical ribs raised along two opposite lateral sides of said second oblong slot;

a tubular eccentric base shaft coupled to said tubular coupling portion of said abrasive plate holder base, said tubular eccentric base shaft comprising a vertically grooved outward bottom flange, a plurality of top screw holes equiangularly spaced on the topmost edge thereof, an inside annular flange, and a bottom screw hole;

a bearing mounted within said tubular eccentric base shaft and supported above said inside annular flange of said tubular eccentric base shaft, having a center through hole;

a headed mandrel inserted through the center through hole on said bearing and secured to said bearing by a screw and a washer, said headed mandrel having a center screw hole, into which the respective screw is threaded from one end;

a trefoil ring plate fastened to the top screw holes on the topmost edge of said tubular eccentric base shaft;

a screw member having an outer thread threaded into the bottom screw hole on said tubular eccentric base shaft, and an inner thread threaded onto the threaded driving shaft of said motor-driven grinding machine;

a split ring mounted around the circular block of said motor-driven grinding machine;

a clamp mounted around said split ring, said clamp comprising a first half-round strip and a second half-round strip longitudinally connected and terminating in a respective eyed end respectively connected together by a screw bolt, the diameter of said first half-round strip being longer than that of said second half-round strip; and a swinging member having an arched base retained between said first half-round strip of said clamp and said split ring, a stepped horizontal block raised from said arched base, a rectangular coupling portion spaced above said stepped horizontal block and coupled to said rectangular block of said abrasive plate holder base, and a plurality of vertical rods connected between said stepped horizontal block and said rectangular coupling portion, said rectangular coupling portion having a longitudinal center through hole connected between said first oblong slot and said second oblong slot by a screw and a nut.

* * * * *